US008998663B1

(12) United States Patent
Bonde et al.

(10) Patent No.: US 8,998,663 B1
(45) Date of Patent: Apr. 7, 2015

(54) METHODS OF MAKING AND OPERATING OUTBOARD MOTORS

(71) Applicant: Brunswick Corporation, Lake Forest, IL (US)

(72) Inventors: Ryan G. Bonde, Kiel, WI (US); John J. Litjens, St. Cloud, FL (US)

(73) Assignee: Brunswick Corporation, Lake Forest, IL (US)

( * ) Notice: Subject to any disclaimer, the term of this patent is extended or adjusted under 35 U.S.C. 154(b) by 149 days.

(21) Appl. No.: 13/786,597

(22) Filed: Mar. 6, 2013

(51) Int. Cl.
*F02N 1/00* (2006.01)
*B63H 20/24* (2006.01)
*B63H 20/28* (2006.01)

(52) U.S. Cl.
CPC ..... *B63H 20/24* (2013.01); *B63H 20/28* (2013.01)

(58) Field of Classification Search
CPC ..... B63B 2770/00
USPC ..... 440/89 R
See application file for complete search history.

(56) References Cited

U.S. PATENT DOCUMENTS 3,911,852 A * 10/1975 Miller et al. ..... 440/89 R
4,036,162 A * 7/1977 Maier et al. ..... 440/56
4,668,199 A * 5/1987 Freund et al. ..... 440/89 R
5,106,330 A * 4/1992 Nelson et al. ..... 440/84
5,232,387 A * 8/1993 Sumigawa ..... 440/89 D
5,487,688 A * 1/1996 Sumigawa ..... 440/88 L
5,954,554 A * 9/1999 Bates ..... 440/89 R
6,733,352 B1 * 5/2004 Belter et al. ..... 440/88 C
7,195,528 B2 * 3/2007 Takada et al. ..... 440/89 G

* cited by examiner

*Primary Examiner* — Lars A Olson
*Assistant Examiner* — Jovon Hayes
(74) *Attorney, Agent, or Firm* — Andrus Intellectual Property Law, LLP

(57) ABSTRACT

An outboard motor and a method of making an outboard motor provide an exhaust conduit having a first end that receives exhaust gas from an internal combustion engine and a second end that discharges exhaust gas to seawater via a propeller shaft housing outlet. An exhaust conduit opening is formed in the exhaust conduit between the first and second ends. The exhaust conduit opening is for discharging exhaust gas from the exhaust conduit to atmosphere via a driveshaft housing of the outboard motor and via an idle exhaust relief outlet and a driveshaft housing outlet in the driveshaft housing. The driveshaft housing outlet is vertically located between the propeller shaft housing outlet and the idle exhaust relief outlet. A cooling pump pumps cooling water from a cooling water inlet for cooling the internal combustion engine to a cooling water outlet for discharging cooling water from the outboard motor. The exhaust conduit opening and cooling water outlet are configured such that the cooling water collects by gravity in the driveshaft housing to a level that is above the exhaust conduit opening.

20 Claims, 13 Drawing Sheets

METHODS OF MAKING AND OPERATING OUTBOARD MOTORS

FIELD

The present disclosure relates to outboard motors and methods of making and operating outboard motors, and more particularly to exhaust systems and cooling systems for outboard motors and methods of making exhaust systems and cooling systems for outboard motors.

BACKGROUND

U.S. Pat. No. 4,036,162, which is incorporated herein by reference, discloses a marine propulsion device which comprises an engine having an exhaust port for discharging exhaust gas, and which also comprises a lower unit having an exhaust tube in communication with the exhaust port. The lower unit includes a cavitation plate submerged in water during idle engine operation, and an exhaust outlet in communication with the exhaust tube. The exhaust outlet affords discharge of the exhaust gas below the cavitation plate. The lower unit includes an outer wall including an outlet, which outer wall outlet is located above the cavitation plate and submerged in water during idle engine operation. The lower unit also includes a passage in communication with the exhaust tube and the outer wall outlet. The passage affords, during reverse engine operation, discharge of a portion of the exhaust gas from the exhaust tube out the outer wall outlet.

U.S. Pat. No. 4,668,199, which is incorporated herein by reference, discloses an exhaust system for an outboard motor, which includes a main exhaust passageway extending through a partially water filled chamber in the driveshaft housing. An inlet idle relief passage connects the top of the chamber with the main exhaust passageway and an outlet passage connects the top of the chamber with the atmosphere. The system thus defines an effective exhaust silencer for the idle exhaust.

U.S. Pat. No. 5,954,554, which is incorporated herein by reference, discloses an outboard drive that involves an improved exhaust system that increases the reverse thrust produced by the outboard drive. The exhaust system includes a first exhaust passage and a second exhaust passage that stems from a first exhaust passage. A flow control device operates within the exhaust system to control exhaust gas flow through second passage depending upon the drive condition (either forward or reverse) of the outboard drive. The flow control device permits exhaust gas flow through the second passage when the outboard drive operates in reverse, while inhibiting exhaust gas flow through the second passage when the outboard drive operates under a forward drive condition. In this manner, the improved exhaust system reduces exhaust gas back pressure and thrust degradation due to exhaust gas entrainment in the propeller when the outboard drive operates in reverse.

U.S. Pat. No. 7,195,528, which is incorporated herein by reference, discloses in an outboard motor exhaust system having a first exhaust gas passage discharging engine exhaust gas into water and a shift actuator operating a shift mechanism to establish one from among a forward position, a reverse position and a neutral position, a second exhaust gas passage is branched from the first exhaust gas passage at a location above the water and an exhaust valve installed in the second exhaust gas passage and connected to the shift mechanism to be opened when the reverse position is established. The exhaust valve is alternatively opened by an exhaust valve actuator installed separately from the shift actuator. With this, it becomes possible to prevent the decrease in thrust produced during reverse boat travel by the engine exhaust gas being sucked in by a propeller, without degrading shift feel.

SUMMARY

This Summary is provided to introduce a selection of concepts that are further described herein below in the detailed description. This Summary is not intended to identify key or essential features of the claimed subject matter, nor is it intended to be used as an aid in limiting the scope of the claimed subject matter.

In certain examples, an outboard motor has an exhaust conduit with a first end that receives exhaust gas from an internal combustion engine and a second end that discharges exhaust gas to seawater via a propeller shaft housing outlet. An idle exhaust relief outlet is located vertically higher than the propeller shaft housing outlet on the outboard motor. The idle exhaust relief outlet receives exhaust gas from the internal combustion engine and discharges the exhaust gas to atmosphere. An exhaust conduit opening is formed in the exhaust conduit between the first and second ends. The exhaust conduit opening is for discharging exhaust gas from the exhaust conduit to atmosphere via a driveshaft housing of the outboard motor and via both the idle exhaust relief outlet and a driveshaft housing outlet in the driveshaft housing. The driveshaft housing outlet is vertically located between the propeller shaft housing outlet and the idle exhaust relief outlet. A cooling water pump pumps cooling water from a cooling water inlet for cooling the internal combustion engine to a cooling water outlet for discharging cooling water from the outboard motor. The exhaust conduit opening and cooling water outlet are configured such that the cooling water collects by gravity in the driveshaft housing to a level that is above the exhaust conduit opening.

In certain examples, methods of making an outboard motor include providing an exhaust conduit having a first end that receives exhaust gas from an internal combustion engine and a second end that discharges exhaust gas to seawater via a propeller shaft housing outlet. An idle exhaust relief outlet is provided and is located vertically higher than the propeller shaft housing outlet on the outboard motor. The idle exhaust relief outlet discharges exhaust gas from the internal combustion engine to atmosphere. An exhaust conduit opening is formed in the exhaust conduit between the first and second ends. The exhaust conduit opening discharges exhaust gas to atmosphere via a driveshaft housing of the outboard motor and via both the idle exhaust relief outlet and a driveshaft housing outlet in the driveshaft housing. The driveshaft housing outlet is located vertically between the propeller shaft housing outlet and the idle exhaust relief outlet. A cooling water pump is provided that pumps cooling water for cooling the internal combustion engine. The cooling water collects by gravity in the driveshaft housing. The method further includes selecting a vertical location of the exhaust conduit opening so that the exhaust conduit opening remains immersed in the cooling water in the driveshaft housing at least during operation of the outboard motor in neutral gear and at idle speed.

BRIEF DESCRIPTION OF THE DRAWINGS

Examples of outboard motors, methods of operating outboard motors, and methods of making outboard motors are described with reference to the following drawing figures. The same numbers are used throughout the figures to reference like features and components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1B:
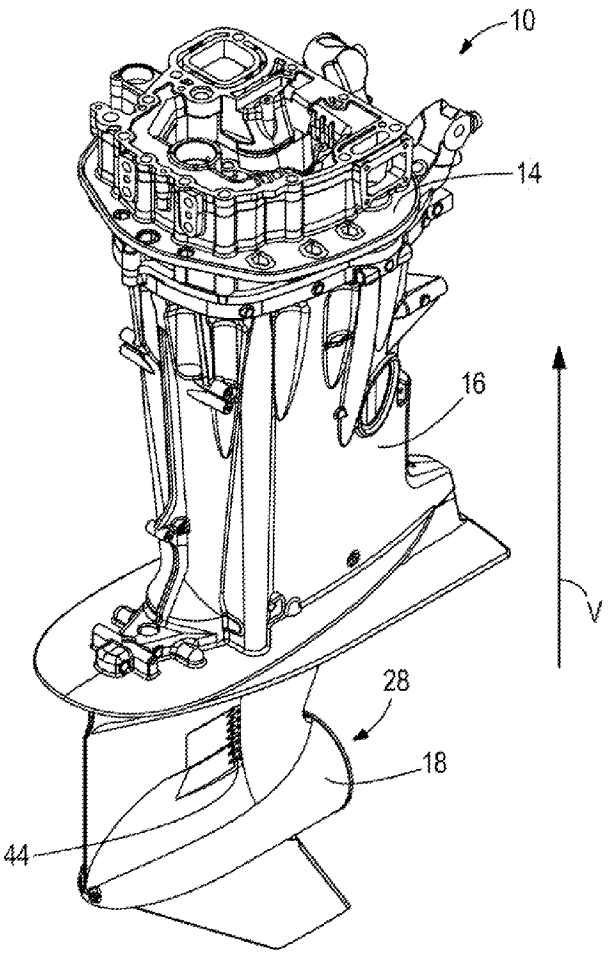
FIGS. 1A and 1B are perspective views of portions of an outboard motor.
Figure 1A:
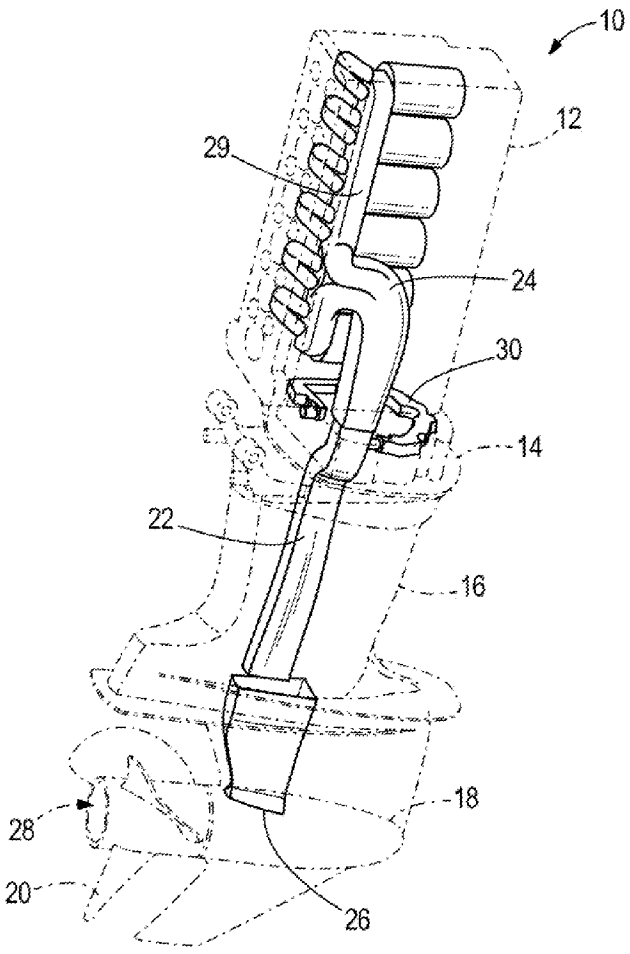

FIGS. 1A and 1B depict an outboard motor 10 for a marine vessel. The outboard motor 10 has an internal combustion engine 12 that is supported on an adapter plate 14, as is conventional. A driveshaft housing 16 is suspended from the adapter plate 14. A gear case and propeller shaft housing 18 is located below the driveshaft housing 16. The gear case and propeller shaft housing 18 encloses a conventional transmission for engaging forward, reverse and neutral gears and thereby causing forward and reverse rotation of propeller 20. An exhaust gas conduit 22 in the form of an exhaust tube has a first end 24 that receives exhaust gas from the internal combustion engine 12 and a second end 26 that discharges the exhaust gas to seawater via a propeller shaft housing outlet 28. The exhaust conduit extends from an exhaust manifold 29 to a lower portion of the driveshaft housing 16.

Figure 2B:
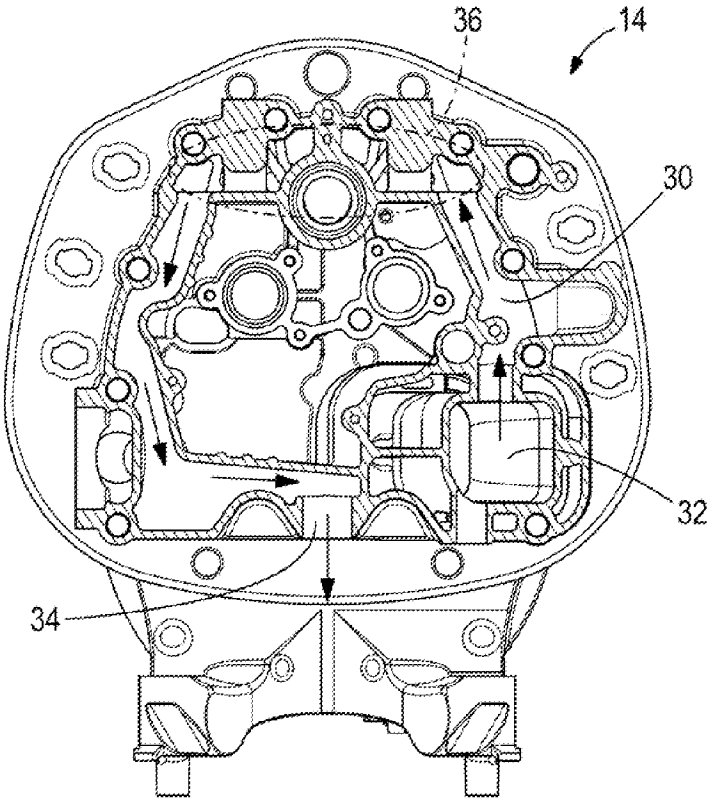
FIG. 2B is a top view of the adapter plate.
Figure 2A:
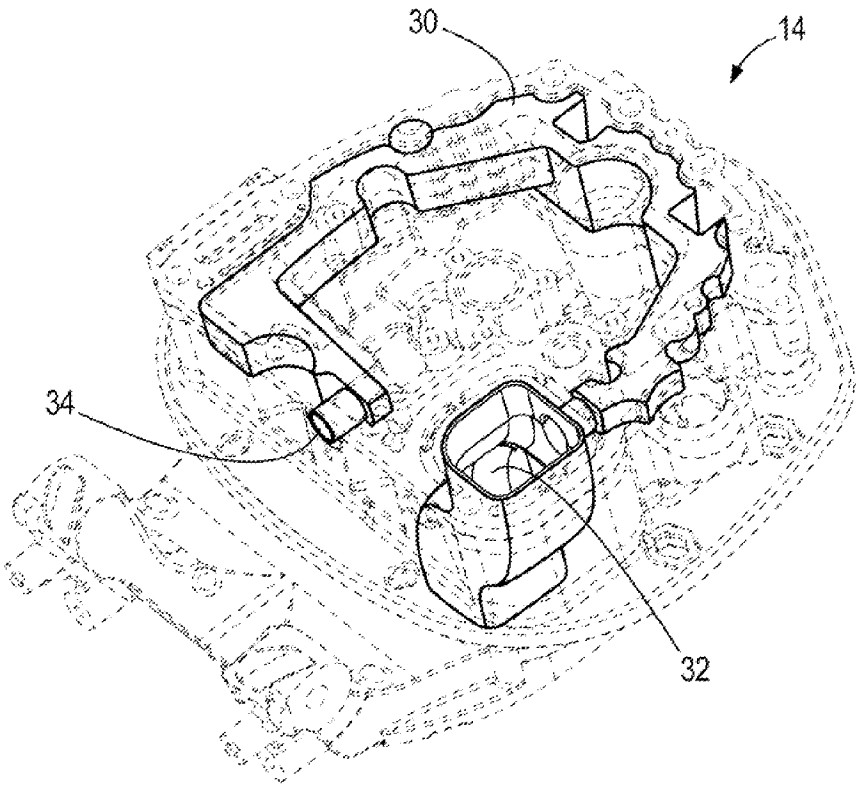
FIG. 2A is a perspective view of an adapter plate for the outboard motor.
Figure 3B:
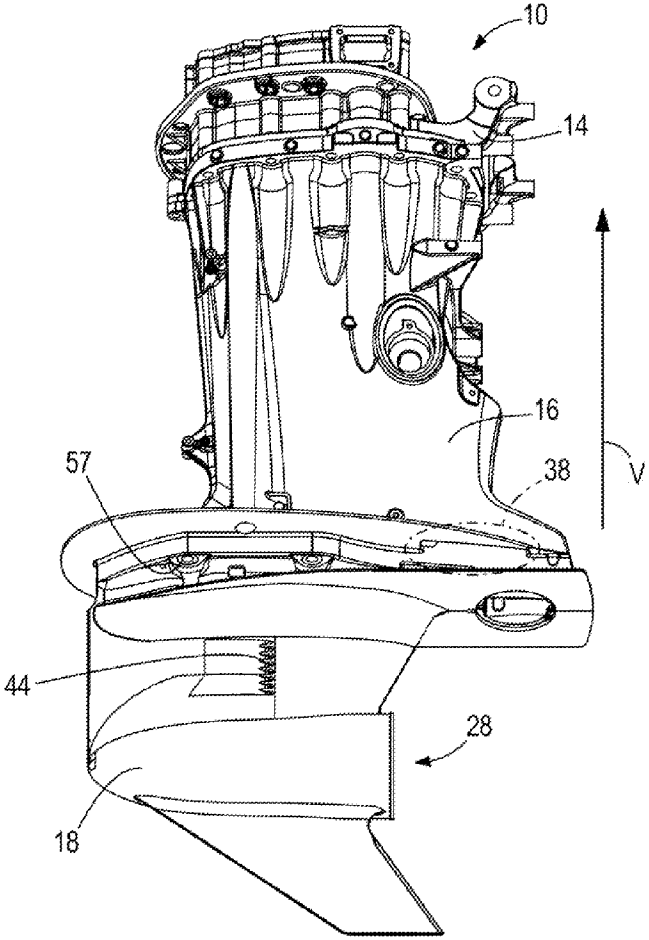
FIGS. 3A and 3B are perspective views of portions of the outboard motor.
Figure 3A:
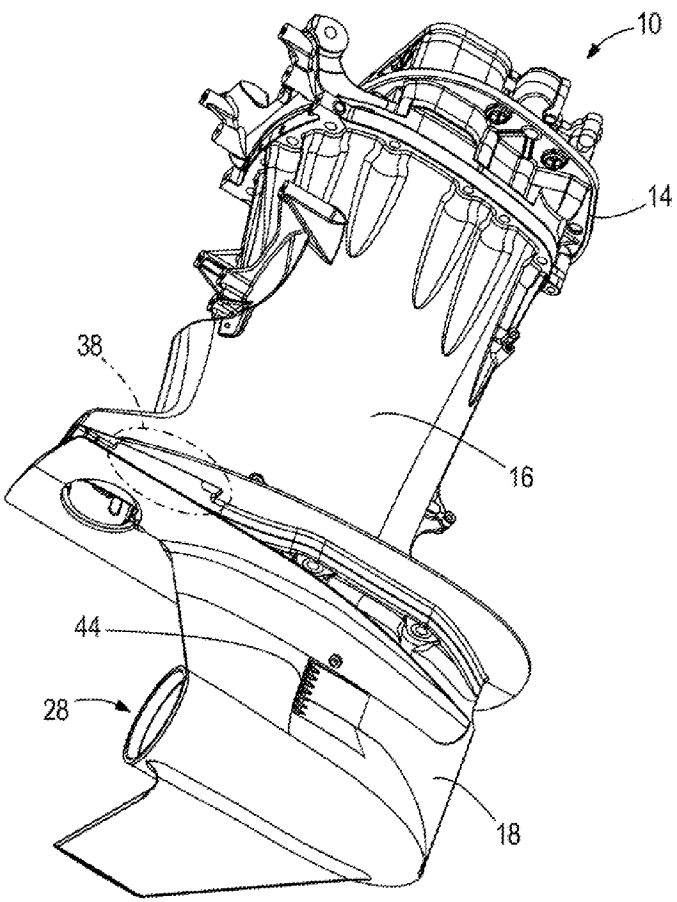
Figure 5C:
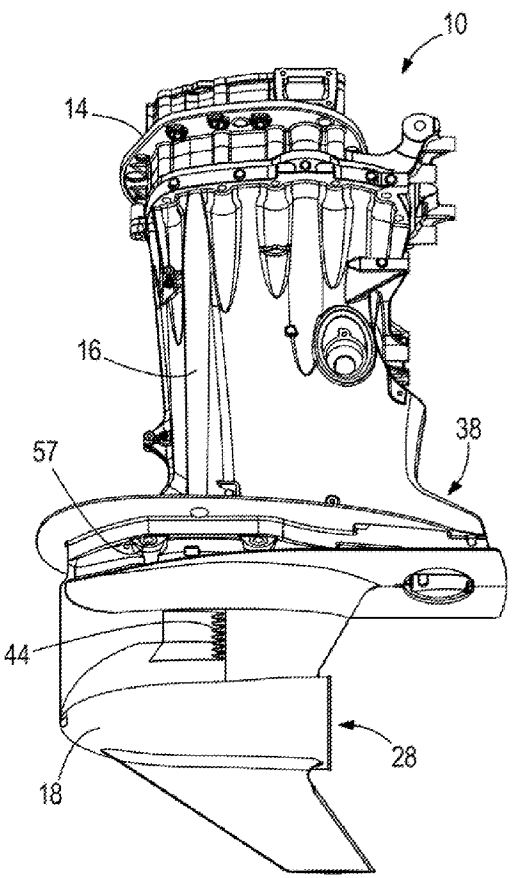
FIGS. 5A-5C are sectional views of the outboard motor showing flow of exhaust gas during certain operational states.
Figure 5B:
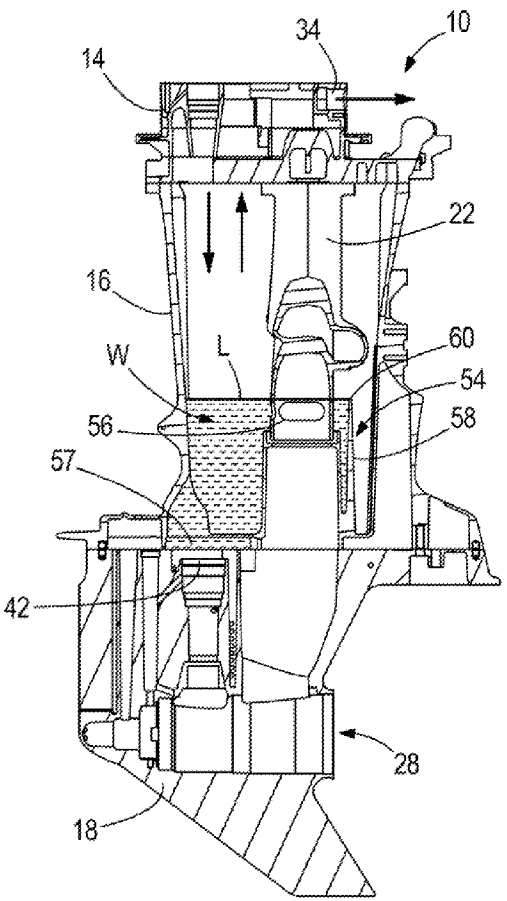
Figure 5A:
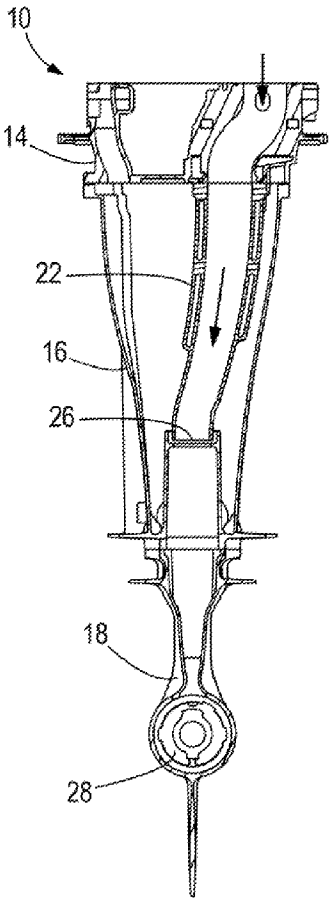
Figure 5D:
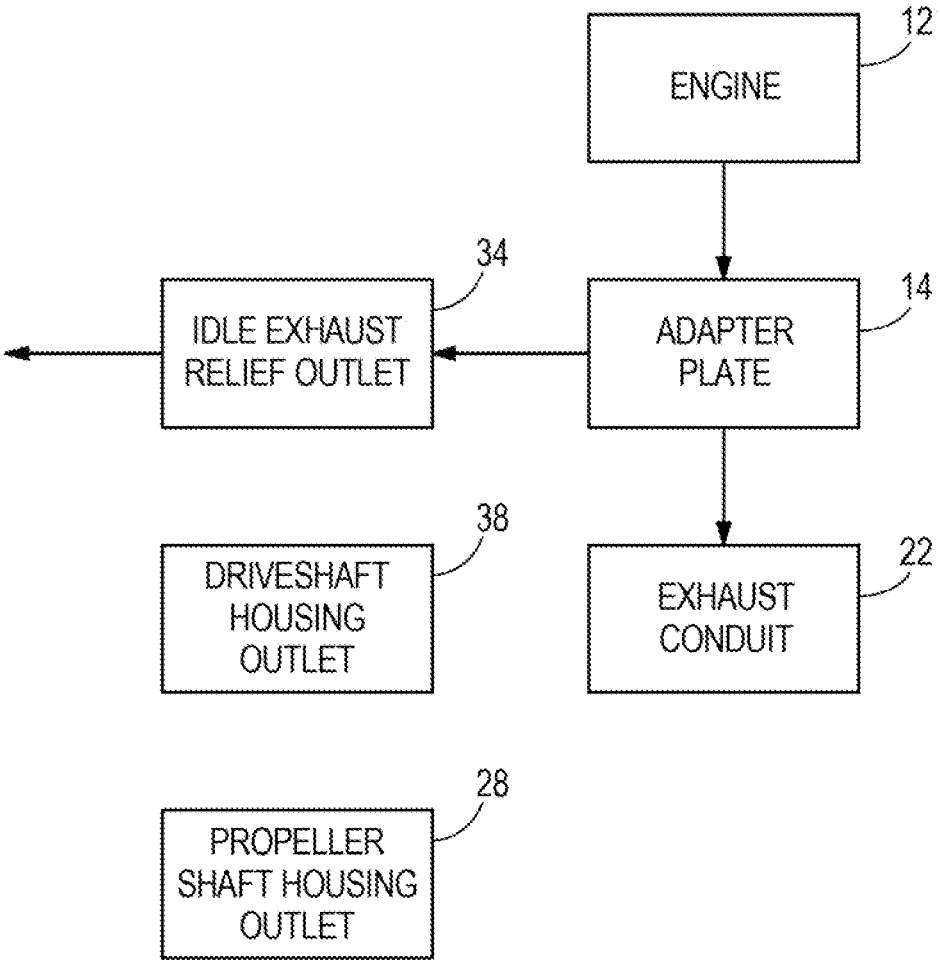
FIG. 5D is a schematic view of the exhaust system for the outboard motor during the operational states of FIGS. 5A-5C.
Figure 6C:
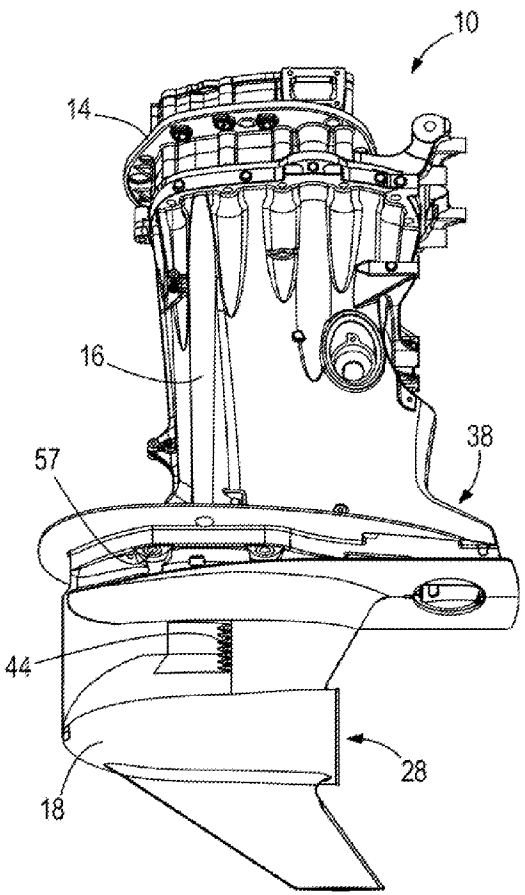
FIGS. 6A-6C are sectional views of the outboard motor showing flow of exhaust gas during certain other operational states.
Figure 6B:
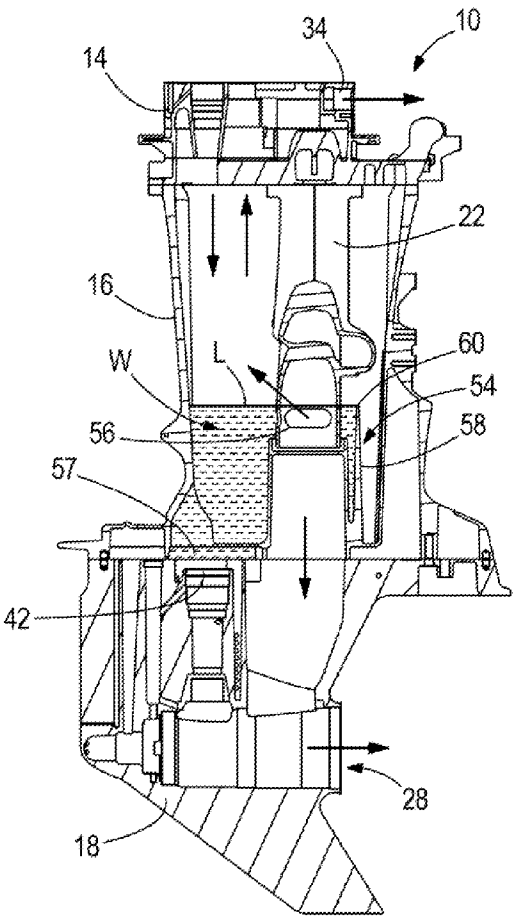
Figure 6A:
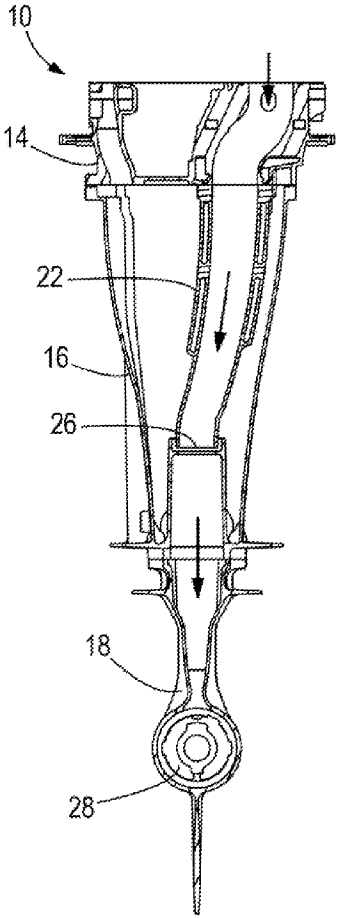
Figure 6D:
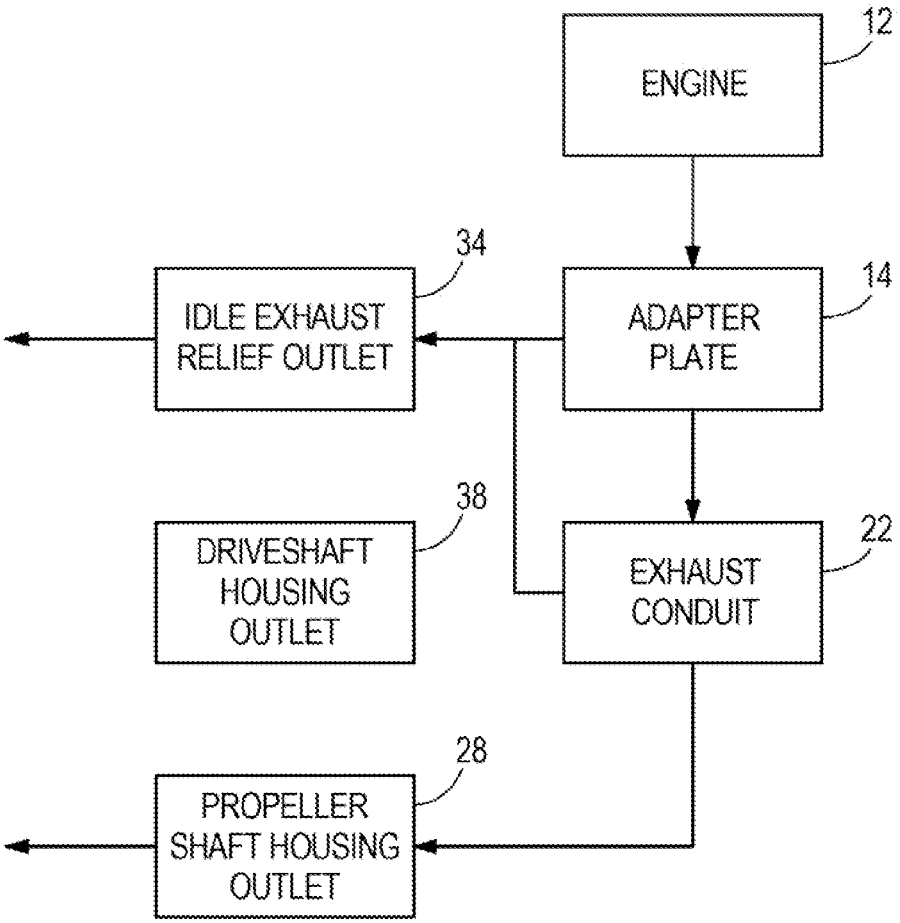
FIG. 6D is a schematic view of the exhaust system for the outboard motor under the operational states of FIGS. 6A-6C.

FIGS. 2A and 2B depict the adapter plate 14 in further detail. The adapter plate 14 forms an idle exhaust gas passage 30 that has an idle exhaust relief inlet 32 receiving exhaust gas and an idle exhaust relief outlet 34 discharging exhaust gas from the outboard motor 10. A conventional idle relief muffler 33 (see schematic depiction in, e.g., FIG. 5D) can be located at the idle exhaust relief outlet 34 to muffle the sound of idle exhaust gas flow. As will be explained further herein below, during certain operational states of the outboard motor 10, exhaust gas flows from the internal combustion engine 12 to the exhaust passage 30 via the idle exhaust relief inlet 32 and then discharges to atmosphere surrounding the outboard motor 10 via the idle exhaust relief outlet 34. FIG. 2B also depicts openings 36, which are formed in the adapter plate 14 and allow flow of exhaust gas to and from the driveshaft housing 16. FIGS. 3A and 3B depict a driveshaft housing outlet 38 formed in the driveshaft housing 16. As will be explained further herein below, during certain operational states of the outboard motor 10, exhaust gas in the driveshaft housing 16 discharges via the driveshaft housing outlet 38 to atmosphere.

As can be seen from FIGS. 1A-3B, in the vertical direction V, the idle exhaust relief outlet 34 is located higher than the propeller shaft housing outlet 28 on the outboard motor 10. The driveshaft housing outlet 38 is located between the propeller shaft housing outlet 28 and the idle exhaust relief outlet 34.

Figure 3E:
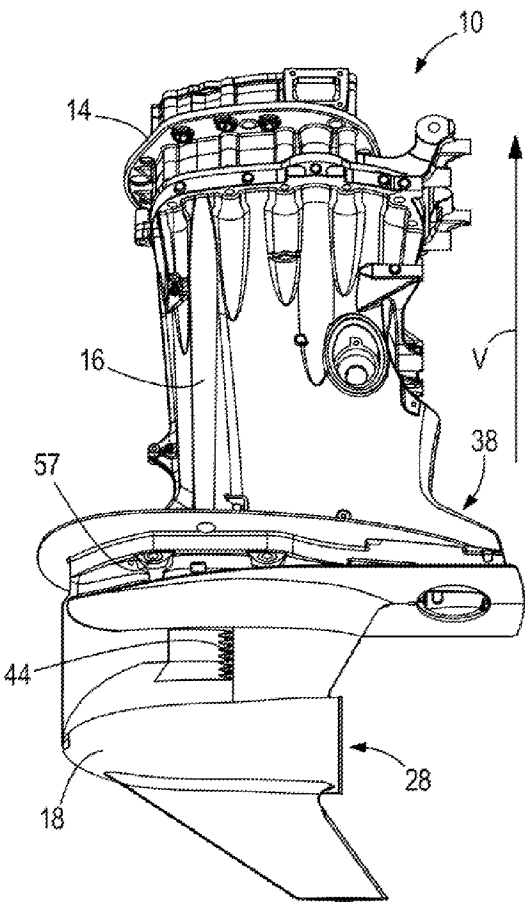
FIGS. 3C-3E are sectional views of the outboard motor showing an exhaust system.
Figure 3D:
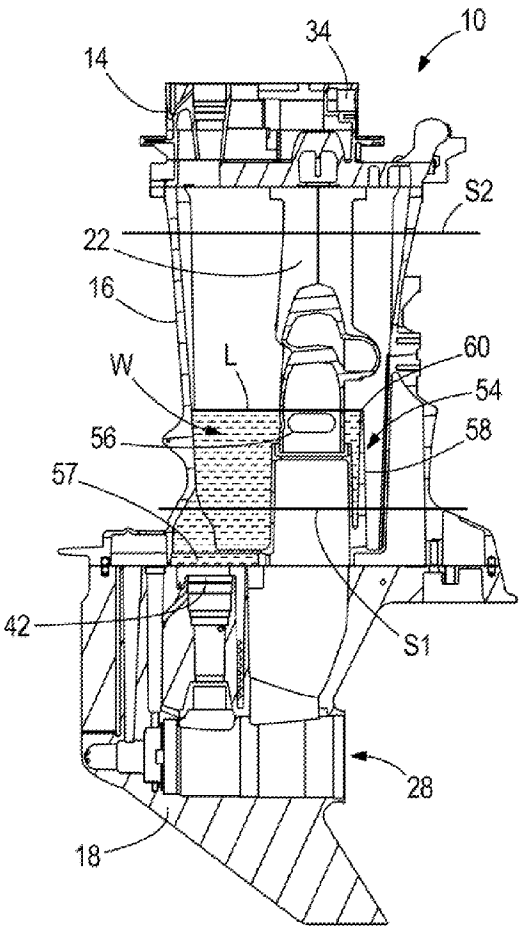
Figure 3C:
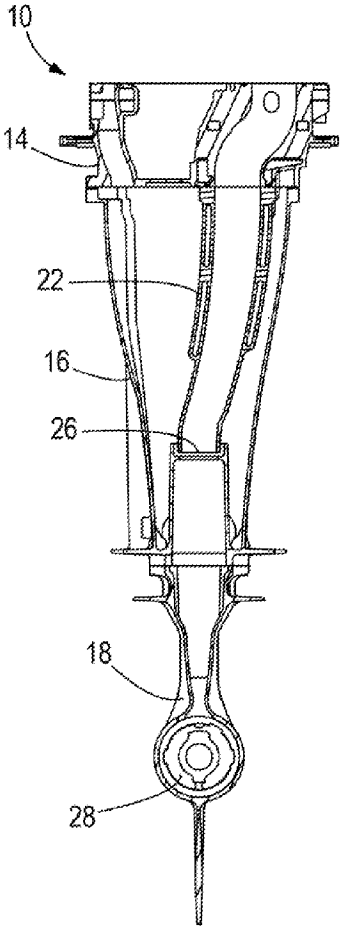

As shown in FIGS. 3C-3E, an exhaust conduit opening 56 is formed in the exhaust gas conduit 22 between the first and second ends 24, 26. As described further herein below, depending upon the operational state of the outboard motor 10, exhaust gas in the exhaust gas conduit 22 is emitted to the driveshaft housing 16 via the exhaust conduit opening 56. Once the exhaust gas is in the driveshaft housing 16, at certain operational states, it can be discharged via one or both of the idle exhaust relief outlet 34 and the driveshaft housing outlet 38.

Figure 4:
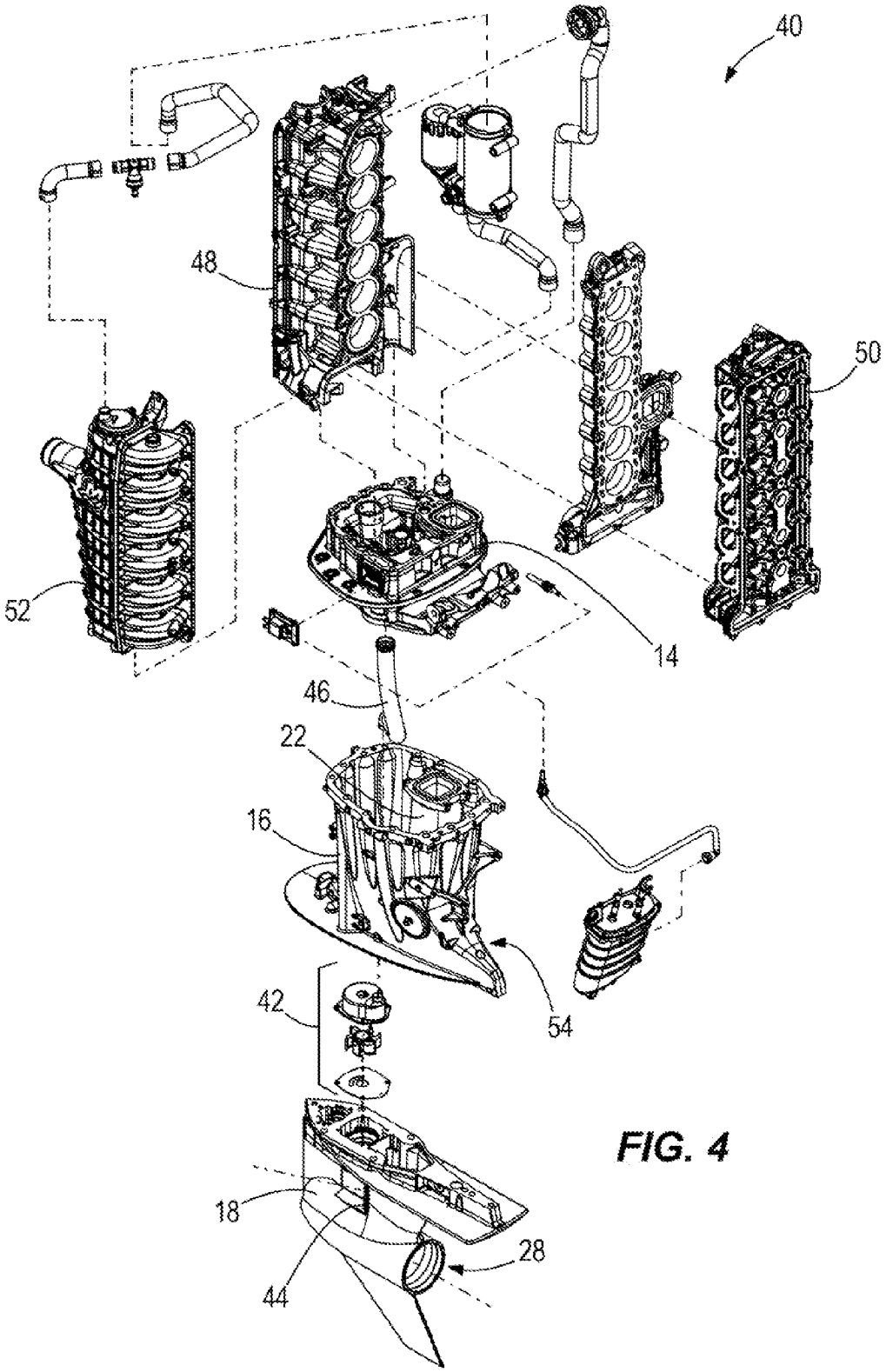
FIG. 4 is an exploded view of a cooling system for the outboard motor.

FIG. 4 depicts a cooling system 40 for cooling various components of the outboard motor 10. A cooling water pump 42 draws raw seawater through a cooling water inlet 44 for cooling the internal combustion engine 12 and optionally for cooling various other components associated with the outboard motor 10. In this example, the cooling water pump 42 pumps cooling water through a water tube 46 connected to the adapter plate 14 and then through a cylinder block 48 of the internal combustion engine 12. Cooling water is also pumped through a cylinder head 50 of the internal combustion engine 12 and through a charge air cooler 52. After exchanging heat with and cooling the cylinder block 48, cylinder head 50, and charge air cooler 52, (and optionally other components) the cooling water drains back through the adapter plate 14 into the driveshaft housing 16. Some of the cooling water is entrained into the exhaust gas flowing through the exhaust gas conduit 22 and is discharged via the propeller shaft housing outlet 28 along with the exhaust gas. Some of the cooling water collects by gravity in the driveshaft housing 16 and is discharged via cooling water outlet 54 (see also e.g. FIGS. 3C-3E) on the driveshaft housing 16 and then via driveshaft housing outlet 38. Collection and discharge of the cooling water in the driveshaft housing 16 is discussed further herein below.

As shown in FIGS. 3C-3E, a baffle 58 is provided at the cooling water outlet 54. The baffle 58 has a top edge 60 that is located vertically higher than the exhaust conduit opening 56. The baffle 58 causes cooling water that drains into the driveshaft housing 16 to collect in the area W shown in cross-hatching. The baffle 58 of the cooling water outlet 54 is thus advantageously configured to maintain the cooling water in the driveshaft housing 16 at a level L that is vertically above the exhaust conduit opening 56. Cooling water that flows over the baffle 58 is discharged via the driveshaft outlet 38. The exhaust conduit opening 56 remains immersed in the cooling water in the driveshaft housing 16 during certain operations of the outboard motor 10. In the examples provided herein below, the exhaust conduit opening 56 remains immersed in the cooling water in the driveshaft housing 16 during all operational states of the outboard motor 10, including when the outboard motor 10 is operated in neutral gear and at idle speed, as well as when the outboard motor 10 is operated in forward and reverse gears at above idle speeds.

As further shown in FIGS. 3C-3E, when the outboard motor 10 is operated in seawater in neutral gear and at idle speed, the seawater enters and drains from the driveshaft housing 16 via an opening 57. The typical ambient level of seawater relative to the exhaust conduit opening 56 can either be below a level of seawater S1 or above a level of seawater S2. The seawater level can change during operation of the outboard motor 10. For example, when the seawater level S2 is above the exhaust conduit opening 56 in neutral gear and at idle speed it will typically fall to a level S1 that is below the exhaust conduit opening 56 when the outboard motor 10 is operated in forward gear and at high speed. The relative sizes of the opening 57 in the driveshaft housing 16 and the cooling water outlet 54 are such that the majority of cooling water that resides in the driveshaft housing 16 ultimately drains out of the cooling water outlet 54 and is discharged via the driveshaft housing outlet 38.

The paths of exhaust flow through the outboard motor 10 and the outlets 28, 34, 38 will vary primarily based upon operational factors that include exhaust flow rate/pressure from the internal combustion engine 12, height of the static waterline surrounding the outboard motor 10, size/geometry and location of the outboard motor 10, and hydrodynamic (pressure) effects caused by rotation of the propeller 20. The height of the static waterline surrounding the outboard motor 10 is also affected by the gear in which the outboard motor 10 is operated, as well as the type of vessel to which the outboard motor 10 is attached and the speed at which the vessel is travelling. Thus changes in the paths exhaust flow through the outlets 28, 34, 38 will occur at certain "critical engine speed values" depending upon the gear in which the outboard motor 10 is operating. These critical engine speed values are determined by the above mentioned factors. In this disclosure, the term "critical engine speed value" means the engine speed at which a change in exhaust flow occurs in the outboard motor 10, such as for example a change in the location(s) of discharge of exhaust gas from the outboard motor via the outlets 28, 34, 38.

During research and experimentation, the present inventor has found that prior art outboard motor configurations often provide inadequate reverse thrust capability. This problem was especially apparent in situations wherein the prior art outboard motor required relatively high levels of thrust in reverse gear. The inventor therefore experimented with different outboard motor configurations, in particular different propeller configurations, different gear case configurations, and different exhaust system configurations in attempts to provide improved thrust capability, and more particularly improved thrust capability in reverse gear. During this experimentation, the inventor found that the exhaust system configuration shown in FIGS. 3C-3E surprisingly achieves the needed improved thrust capability in reverse gear.

In reverse gear, at certain critical engine speed values, exhaust gas begins to flow through the propeller shaft housing outlet 28 and thereafter can cause "ventilation" of the propeller 20 as the exhaust gas flows across the blades of the propeller 20 and displaces water. Ventilation undesirably limits thrust capabilities of the propeller 20. Upon examination, the inventor found that because the exhaust conduit opening 56 of the outboard motor 10 shown in FIGS. 3C-3E diverts a portion of the exhaust gas flow away from the gear case and propeller shaft housing 18, ventilation of the propeller 20 occurs at relatively higher engine speeds in reverse gear. That is, the exhaust conduit opening 56 diverts exhaust gas into the driveshaft housing 16, which would otherwise discharge to the gear case and propeller shaft housing 18 and cause ventilation at lower engine speeds. By increasing the critical engine speed at which exhaust gas begins to flow through the propeller shaft housing outlet 28, increased thrust capability at higher engine speeds is provided.

More specifically, while operating the outboard motor 10 in reverse gear, diversion of exhaust gas away from the propeller shaft housing outlet 28 is achieved by forming the exhaust conduit opening 56 in the exhaust gas conduit 22 between the first and second ends 24, 26. The exhaust conduit opening 56 discharges exhaust gas via the driveshaft housing 16 of the outboard motor 10, and then via both the idle exhaust relief outlet 34 and driveshaft housing outlet 38. Without the exhaust conduit opening 56, this portion of the exhaust gas would discharge to the propeller shaft housing outlet 28, leading to the noted ventilation of propeller 20. The present inventor has discovered that by forming the exhaust conduit opening 56 in the exhaust gas conduit 22, the critical engine speed value at which ventilation occurs is increased, thus providing increased thrust capability at higher speeds, in reverse gear.

However, through experimentation, the present inventor has also found that the outboard motor 10 shown in FIGS. 3C-3E is relatively noisy, especially at idle speeds, as compared to prior art outboard motors that do not have the exhaust conduit opening 56. Therefore, the outboard motor 10 shown in FIGS. 3C-3E may not comply with noise standard levels and/or will otherwise be annoying to operators and those in the vicinity of the outboard motor 10. The inventor thus also endeavored to solve this problem, as further described herein below.

FIGS. 5-8 depict exhaust flow paths through the outboard motor 10 at different respective operational states, namely different gears and engine speeds.

FIGS. 5A-5D include arrows depicting flow of exhaust gas through the outboard motor 10 when the internal combustion engine 12 is operated in neutral gear at idle speed. In this operational state, the propeller shaft housing outlet 28 and driveshaft housing outlet 38 are below a static seawater-level surrounding the outboard motor 10. In this example, the relatively low flow rate of the exhaust gas and the size/geometry of the openings are such that no exhaust gas flows through these outlets 28, 38. The propeller 20 is not spinning, so it has no effect on exhaust gas flow. Exhaust gas only flows through the adapter plate 14 and out of the outboard motor 10 via the idle exhaust relief outlet 34. In this state, the present inventor has found that configuring the cooling water outlet 54 and selecting the vertical location of the exhaust conduit opening 56 such that the exhaust conduit opening 56 remains immersed in the cooling water in the driveshaft housing 16 (i.e. remains below the surface of the cooling water, below the cooling water line L) prevents flow of exhaust gas through the exhaust conduit opening 56 and thereby advantageously minimizes what would otherwise be disruptive noise levels from the outboard motor 10.

FIGS. 6A-6D include arrows depicting flow of exhaust gas through the outboard motor 10 when the outboard motor 10 is operated in forward gear at idle or relatively low speeds. In this state, both the propeller shaft housing outlet 28 and driveshaft housing outlet 38 remain below a static seawater-level. The relatively low flow rate of the exhaust gas and the size/geometry of the outlets 28, 34, 38 are such that no exhaust gas flows through outlets 28, 38. The slightly lower pressure at the propeller shaft housing outlet 28 caused by the spinning propeller 20 causes the exhaust gas to primarily flow out of the gear case and propeller shaft housing 18. A relatively smaller portion of exhaust gas flows out of the outboard motor 10 via the idle exhaust relief outlet 34. Again, by configuring the cooling water outlet 54 and selecting the vertical location of the exhaust conduit opening 56 such that the exhaust conduit opening 56 remains immersed in the cooling water in the driveshaft housing 16 during operation of the outboard motor in forward gear at above-idle speeds, noise levels emitted by the outboard motor 10 are minimized.

FIGS. 7A-7D include arrows depicting flow of exhaust gas through the outboard motor 10 when it is operated in forward gear at relatively high speeds. In this operational state, the propeller shaft housing outlet 28 remains immersed in seawater, however the driveshaft housing outlet 38 will have a tendency to become exposed above seawater, or very close to exposed above seawater. This is due to the displacement of seawater as the marine vessel is moving forward. In this state, the majority of exhaust gas is discharged through the propeller shaft housing outlet 28, but the portion of the exhaust gas that passes through the exhaust conduit opening 56 will now exit through the idle exhaust relief outlet 34 and driveshaft housing outlet 38. Again, configuring the cooling water outlet 54 and selecting the vertical location of the exhaust conduit opening 56 so that the exhaust conduit opening 56 remains immersed in the cooling water in the driveshaft housing 16 during operation of the outboard motor 10 in forward gear at high speeds reduces noise levels of the outboard motor 10.

FIGS. 5A-5D also depict flow of exhaust gas through the outboard motor 10 when the outboard motor 10 is operated in reverse gear at idle and a first, relatively low speed (i.e. a first reverse speed). The propeller shaft housing outlet 28 and driveshaft housing outlet 38 remain under water. A slightly higher pressure exists at the propeller shaft housing outlet 28 due to the spinning propeller 20. This acts to prevent exhaust gas from flowing through the propeller shaft housing outlet 28. All the exhaust gas flows through the idle exhaust relief outlet 34. Again, configuring the cooling water outlet 54 and selecting the vertical location of the exhaust conduit opening 56 so that the exhaust conduit opening 56 remains immersed in the cooling water in the driveshaft housing 16 during operation of the outboard motor 10 in reverse gear at idle and the first, low reverse speed reduces noise levels of the outboard motor 10.

FIGS. 8A-8D include arrows depicting flow of exhaust gas through the outboard motor 10 when the outboard motor 10 is operated in reverse gear at a second, relatively higher speed (i.e. a second reverse speed that is higher than the first reverse speed). As engine speed increases in reverse gear operation, exhaust gas flow increases. Exhaust gas continues to flow through the idle exhaust relief outlet 34, and at a critical engine speed value exhaust gas begins to flow through the driveshaft housing outlet 38. At this point, exhaust gas will have a tendency not to flow through the propeller shaft housing outlet 28. Again, configuring the cooling water outlet 54 and selecting the vertical location of the exhaust conduit opening 56 so that the exhaust conduit opening 56 remains immersed in the cooling water in the driveshaft housing 16 during operation of the outboard motor 10 in reverse gear and at the second, relatively higher reverse speed reduces noise levels emitted from the outboard motor 10.

Figure 7C:
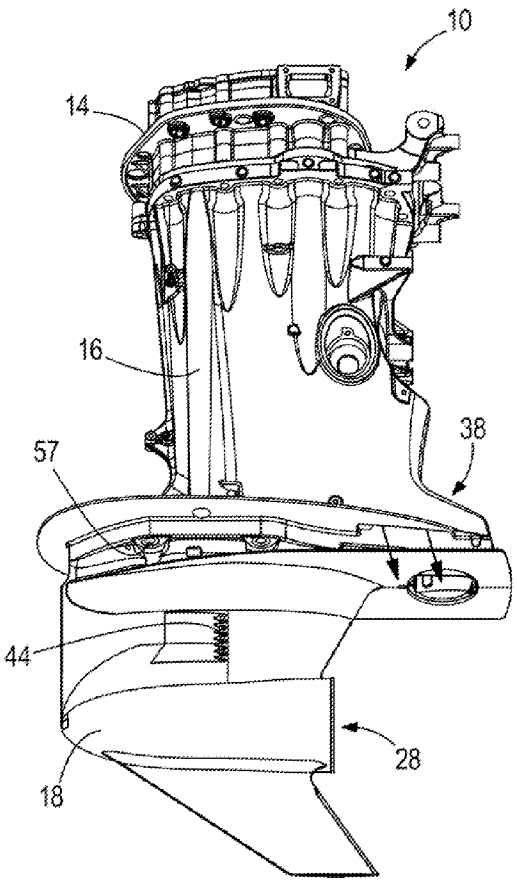
FIGS. 7A-7C are sectional views of the outboard motor showing flow of exhaust gas during certain other operational states.
Figure 7B:
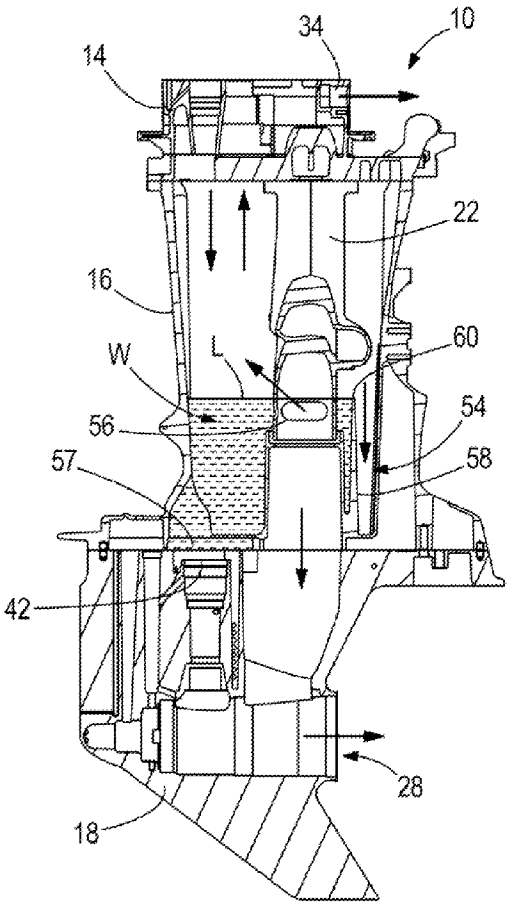
Figure 7A:
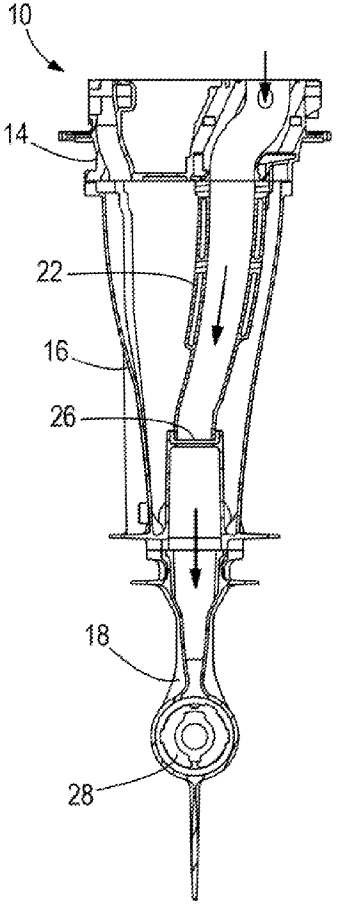
Figure 7D:
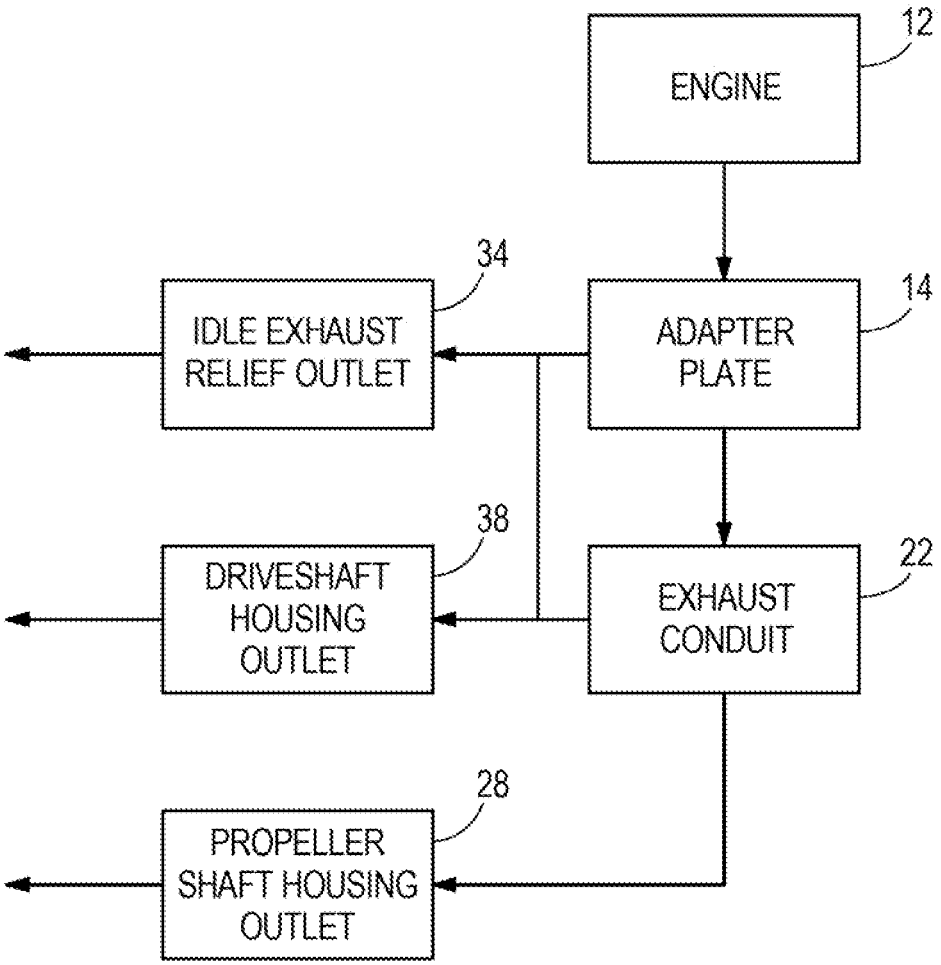
FIG. 7D is a schematic view of an exhaust system for the outboard motor under the operational states shown in FIGS. 7A-7C.
Figure 8C:
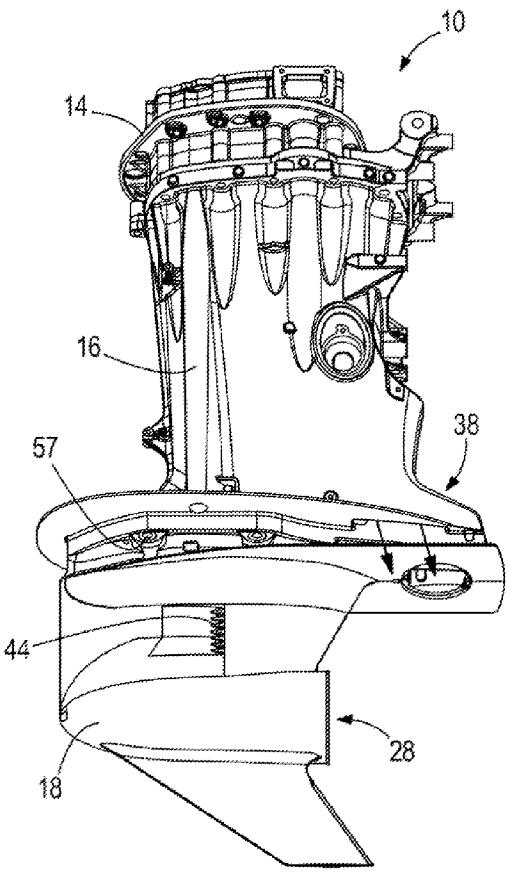
FIGS. 8A-8C are sectional views of the outboard motor showing flow of exhaust gas during certain other operational states.
Figure 8B:
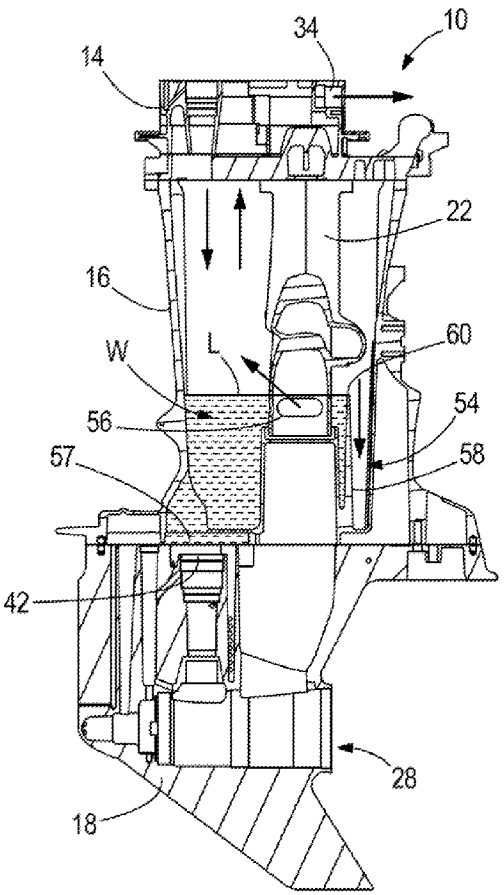
Figure 8A:
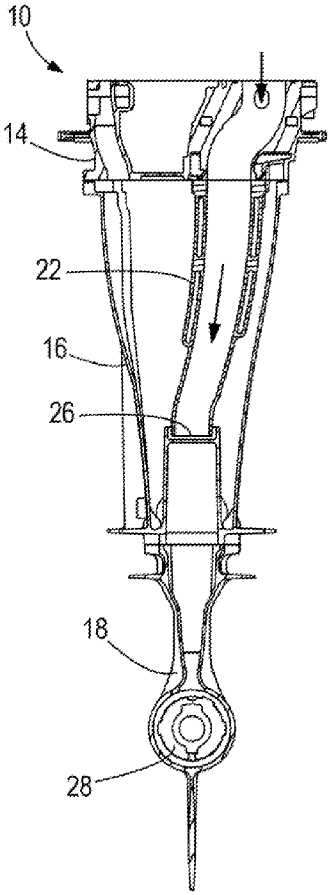
Figure 8D:
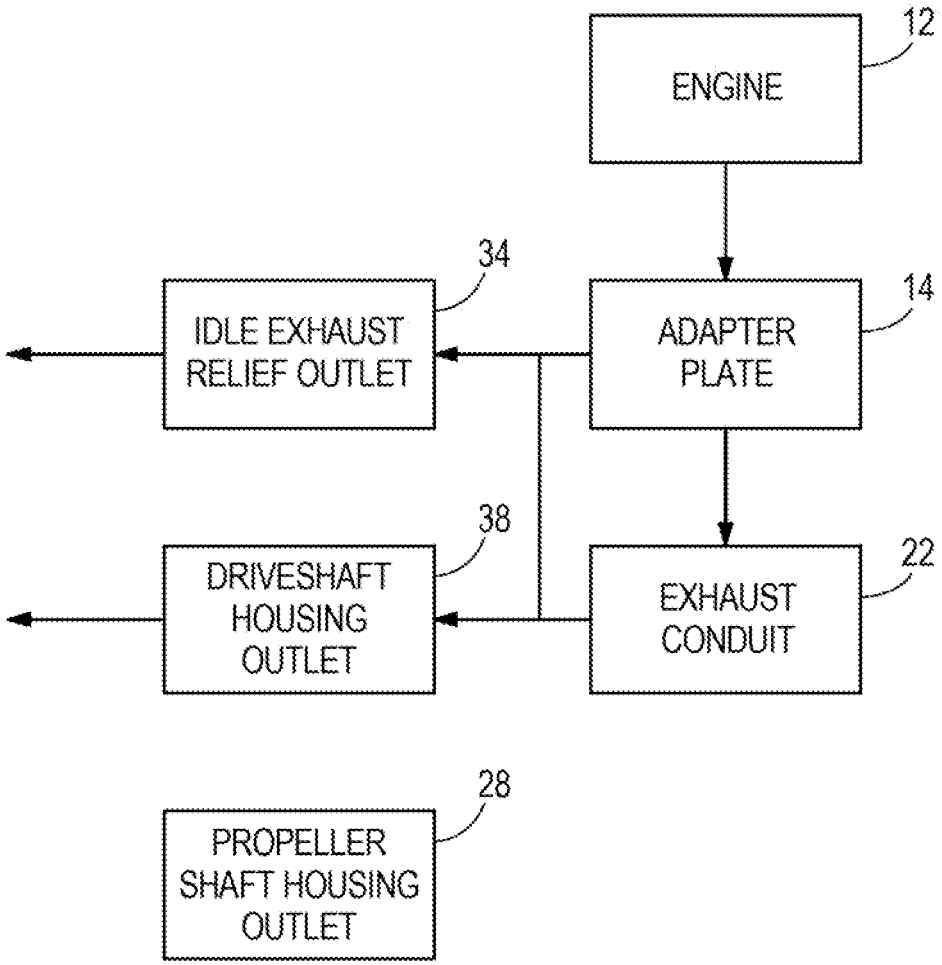
FIG. 8D is a schematic view of an exhaust system for the outboard motor under the operational states shown in FIGS. 8A-8C.

FIGS. 7A-7B also depict flow of exhaust gas through the outboard motor 10 when the outboard motor 10 is operated in reverse gear at a third, relatively higher reverse speed (i.e. a third reverse speed that is higher than the second reverse speed). At a certain critical engine speed value, exhaust gas will begin to flow through the propeller shaft housing outlet 28. The present inventor has determined that inclusion of the exhaust conduit opening 56 in the outboard motor 10 has little discernible effect on the critical engine speed value at which exhaust gas begins to flow through both the idle exhaust relief outlet 34 and the driveshaft housing outlet 38, as shown in FIG. 8D. However, inclusion of the exhaust conduit opening 56 surprisingly does have an increasing effect on the critical engine speed value at which the exhaust gas begins to flow through the gear case and propeller shaft housing 18 and ventilate the propeller blades, as shown in FIGS. 7A-7D. Thus the inclusion of the exhaust conduit opening 56 allows the internal combustion engine 12 to run at a greater speed before ventilation of the propeller 20 occurs—thereby allowing it to produce an increased amount of reverse thrust compared to prior art outboard motor arrangements.

It will thus be seen by those having ordinary skill in the art that the present disclosure provides a method of making an outboard motor 10 by providing an exhaust gas conduit 22 having a first end 24 that receives exhaust gas from an internal combustion engine 12 and a second end 26 that discharges exhaust gas to seawater via a propeller shaft housing outlet 28. The method can include providing an idle exhaust relief outlet 34 located vertically higher than the propeller shaft housing outlet 28 on the outboard motor 10. The idle exhaust relief outlet 34 discharges exhaust gas from the internal combustion engine 12 to atmosphere. The method can include forming an exhaust conduit opening 56 between the first and second ends 24, 26. The exhaust conduit opening 56 discharges exhaust gas to atmosphere via a driveshaft housing 16 of the outboard motor 10 and via both the idle exhaust relief outlet 34 and a driveshaft housing outlet 38 in the driveshaft housing 16. The driveshaft housing outlet 38 is located vertically between the propeller shaft housing outlet 28 and the idle exhaust relief outlet 34. The method can further include providing a cooling water pump 42 that pumps cooling water for cooling the internal combustion engine 12. The cooling water collects by gravity in the driveshaft housing 16. The method also includes selecting a vertical location of the exhaust conduit opening 56 so that the exhaust conduit opening 56 remains immersed in the cooling water in the driveshaft housing 16 at least during operation of the outboard motor in neutral gear and at idle speed. The vertical location of the exhaust conduit opening 56 can be selected as a function of the speed of the internal combustion engine 12 at which exhaust gas begins to discharge through the propeller shaft housing outlet 28, thus allowing for operation of the outboard motor at higher speeds without ventilation of the propeller 20. The vertical location of the exhaust conduit opening 56 can be selected so that when the outboard motor 10 is operated in neutral gear and at idle speed, the cooling water maintains a level L that is vertically above the exhaust conduit opening 56 and exhaust gas does not flow through the exhaust conduit opening 56, thus lessening noise emitted by the outboard motor 10. When the outboard motor 10 is operated in neutral gear and at idle speed, exhaust gas is discharged from the internal combustion engine 12 only to atmosphere via the idle exhaust relief outlet 34, thus lessening noise. Further operation of the outboard motor in forward and reverse gears at above idle speeds will result in discharge of exhaust gas through one or more of the idle exhaust relief outlet 34, propeller shaft housing outlet 28, and driveshaft housing outlet 38, depending upon size and geometry of the respective outlets, as well as the speed of the internal combustion engine 12 and pressure of the exhaust gas flow. Critical points at which exhaust gas begins to flow through the respective outlets, including notably the propeller shaft housing outlet 28 can be controlled based upon the geometry and respective locations and sizes of the outlets.

What is claimed is:

1. An outboard motor comprising:

an exhaust conduit having a first end that receives exhaust gas from an internal combustion engine and a second end that discharges exhaust gas to seawater via a propeller shaft housing outlet;

an idle exhaust relief outlet that is located vertically higher than the propeller shaft housing outlet on the outboard motor, the idle exhaust relief outlet receiving exhaust gas from the internal combustion engine and discharging the exhaust gas to atmosphere;

an exhaust conduit opening formed in the exhaust conduit between the first and the second ends, the exhaust conduit opening for discharging exhaust gas from the exhaust conduit to atmosphere via a driveshaft housing of the outboard motor and via both the idle exhaust relief outlet and a driveshaft housing outlet in the driveshaft housing, the driveshaft housing outlet being vertically located between the propeller shaft housing outlet and the idle exhaust relief outlet; and a cooling water pump that pumps cooling water from a cooling water inlet for cooling the internal combustion engine to a cooling water outlet for discharging cooling water from the outboard motor;

wherein the exhaust conduit opening and cooling water outlet are configured such that the cooling water collects by gravity in the driveshaft housing to a level that is above the exhaust conduit opening.

2. The outboard motor according to claim 1, wherein the cooling water outlet is provided with a baffle having a top edge that is located vertically higher than the exhaust conduit opening, wherein the baffle maintains the cooling water in the driveshaft housing at the level that is above the exhaust conduit opening.

3. The outboard motor according to claim 1, wherein the exhaust conduit opening and cooling water outlet are configured such that the exhaust conduit opening remains immersed in the cooling water in the driveshaft housing at least during operation of the outboard motor in neutral gear and at idle speed.

4. The outboard motor according to claim 1, wherein the exhaust conduit opening and cooling water outlet are configured such that the exhaust conduit opening remains immersed in the cooling water in the driveshaft housing during operation of the outboard motor in forward and reverse gears and at above-idle speeds.

5. The outboard motor according to claim 1, wherein when the outboard motor is operated in seawater in neutral gear and at idle speed, the exhaust conduit opening is located above an ambient level of seawater that collects in the driveshaft housing.

6. A method of making an outboard motor, the method comprising:

providing an exhaust conduit having a first end that receives exhaust gas from an internal combustion engine and a second end that discharges exhaust gas to seawater via a propeller shaft housing outlet;

providing an idle exhaust relief outlet located vertically higher than the propeller shaft housing outlet on the outboard motor, the idle exhaust relief outlet discharging exhaust gas from the internal combustion engine to atmosphere;

forming an exhaust conduit opening in the exhaust conduit between the first and the second ends, the exhaust conduit opening discharging exhaust gas to atmosphere via a driveshaft housing of the outboard motor and via both the idle exhaust relief outlet and a driveshaft housing outlet in the driveshaft housing, the driveshaft housing outlet being located vertically between the propeller shaft housing outlet and the idle exhaust relief outlet;

providing a cooling water pump that pumps cooling water for cooling the internal combustion engine, wherein the cooling water collects by gravity in the driveshaft housing; and selecting a vertical location of the exhaust conduit opening so that the exhaust conduit opening remains immersed in the cooling water in the driveshaft housing at least during operation of the outboard motor in neutral gear and at idle speed.

7. The method according to claim 6, comprising selecting the vertical location of the exhaust conduit opening so that when the outboard motor is operated in neutral gear and at idle speed, the cooling water maintains a level that is vertically above the exhaust conduit opening, and exhaust gas does not flow through the exhaust conduit opening.

8. The method according to claim 7, comprising selecting the vertical location of the exhaust conduit opening so that when the outboard motor is operated in neutral gear and at idle speed, exhaust gas is discharged from the internal combustion engine only to atmosphere via the idle exhaust relief outlet.

9. The method according to claim 7, wherein when the outboard motor is operated in forward gear at a first forward speed, exhaust gas is discharged from the internal combustion engine to atmosphere only via the idle exhaust relief outlet and to seawater via the propeller shaft housing outlet.

10. The method according to claim 9, wherein when the outboard motor is operated in forward gear at a second forward speed that is greater than the first forward speed, exhaust gas is discharged from the internal combustion engine to atmosphere via both the idle exhaust relief outlet and the driveshaft housing outlet and to seawater via the propeller shaft housing outlet.

11. The method according to claim 7, wherein when the outboard motor is operated in reverse gear at a first reverse speed, exhaust gas is discharged from the internal combustion engine only to atmosphere via the idle exhaust relief outlet.

12. The method according to claim 11, wherein when the outboard motor is operated in a second reverse speed that is greater than the first reverse speed, exhaust gas is discharged from the internal combustion engine to atmosphere only via the idle exhaust relief outlet and to seawater via the propeller shaft housing outlet.

13. The method according to claim 12, wherein when the outboard motor is operated in a third reverse speed that is greater than the first and second reverse speeds, exhaust gas is discharged from the internal combustion engine to atmosphere via the idle exhaust relief outlet and the driveshaft housing outlet and to seawater via the propeller shaft housing outlet while operating the outboard motor.

14. The method according to claim 13, comprising selecting the vertical location of the exhaust conduit opening as a function of the third speed of the internal combustion engine, at which exhaust gas begins to discharge through the propeller shaft housing outlet.

15. The method according to claim 6, wherein the exhaust gas begins discharging to seawater via the propeller shaft housing at a critical engine speed value, and comprising selecting the vertical location of the exhaust conduit opening based upon the critical engine speed value.

16. The method according to claim 6, comprising selecting the vertical location of the exhaust conduit opening so that the cooling water maintains a level that is vertically above the exhaust conduit opening when the outboard motor is operated in forward and reverse gears at above idle speeds.

17. The method according to claim 6, comprising providing a cooling water outlet for discharging cooling water from the outboard motor with a baffle having a top edge that is located vertically higher than the exhaust conduit opening, wherein the baffle maintains the cooling water in the driveshaft housing at the level that is above the exhaust conduit opening.

18. The method according to claim 17, comprising configuring respective heights of the exhaust conduit opening and baffle such that the exhaust conduit opening remains immersed in the cooling water at least during operation of the outboard motor in neutral gear and idle speed.

19. The method according to claim 17 comprising configuring the exhaust conduit opening and baffle such that the exhaust conduit opening remains immersed in the cooling water at least during operation of the outboard motor in forward and reverse gears at above-idle speeds.

20. The method according to claim 6 comprising selecting the vertical location of the exhaust conduit opening as a function of a speed of the internal combustion engine at which exhaust gas begins to discharge through the exhaust conduit opening.

* * * * *